United States Patent [19]

Jessup

[11] 4,192,102

[45] Mar. 11, 1980

[54] CENTERLESS PLUNGE GRINDING MACHINE WITH PROGRESSIVE ANGLE DEVELOPMENT

[75] Inventor: Wilbur F. Jessup, The Hague, Netherlands

[73] Assignee: Cincinnati Milacron Inc., Cincinnati, Ohio

[21] Appl. No.: 924,846

[22] Filed: Jul. 14, 1978

Related U.S. Application Data

[63] Continuation-in-part of Ser. No. 803,569, Jun. 6, 1977, Pat. No. 4,107,881.

[51] Int. Cl.[2] ..... B24B 5/32

[52] U.S. Cl. ..... 51/103 R; 51/103 TF

[58] Field of Search ..... 51/103 R, 103 WH, 103 TF, 51/165.87

[56] References Cited

U.S. PATENT DOCUMENTS

| | | | |
|---|---|---|---|
| 1,669,728 | 5/1928 | Vanderbeck | 51/103 WH |
| 1,862,882 | 6/1932 | Caster | 51/103 WH |
| 2,016,478 | 10/1935 | Becker | 51/103 TF |
| 2,110,086 | 3/1938 | Indge | 51/103 TF |
| 2,137,821 | 11/1938 | Dunbar et al. | 51/103 TF |
| 3,408,773 | 11/1968 | Cole et al. | 51/103 R |
| 4,107,881 | 8/1978 | Jessup | 51/103 R |

*Primary Examiner*—Gary L. Smith
*Assistant Examiner*—Robert P. Olszewski
*Attorney, Agent, or Firm*—Thomas M. Farrell

[57] ABSTRACT

A centerless grinder is adapted to have a regulating wheel feed radially towards a grinding wheel about a pivot point to accomplish an infeed grind operation on a plurality of parts between the wheels. The parts are infeed ground at a plurality of stations from an inlet end of the wheels to an outlet end of the wheels, when the pivot point is proximate the outlet end, thereby achieving variable feed distances and variable feed rates along the face of the regulating wheel relative to the grinding wheel, from the inlet end to the outlet end. After such an infeed grind operation, the plurality of parts are advanced to their next adjacent stations for a subsequent grind operation. By the arrangement disclosed, coarse-feed grinding is performed on one workpiece while fine-feed grinding is performed on another piece and varying degrees of rates of grinding are performed on the intermediate pieces during the same time interval. By predetermined angling of the wheel faces at each station, the final workpiece cone becomes the initial workpiece cone at the next adjacent station, thus causing the grind to start along the entire length of the part, tending to lessen wheel wear and improve grinding efficiency.

3 Claims, 5 Drawing Figures

CENTERLESS PLUNGE GRINDING MACHINE WITH PROGRESSIVE ANGLE DEVELOPMENT

This application is a continuation-in-part of my application for Centerless Grinding Machine, Serial No. 803,569, filed June 6, 1977 issued as U.S. Pat. No. 4,107,881, Aug. 22, 1978.

BACKGROUND OF THE INVENTION

One prior art method of centerless grinding cylindrical parts of rotation is to stack them and simultaneously grind a plurality of workpieces carried between the wheels of a centerless grinder. The workpieces are stacked end-to-end and "infeed", or plunge ground, by the grinding wheel. By progressive profiling of the regulating wheel, the cylindrical parts will have progressively stepped diameters, from a rough, stack-entering workpiece; to a smaller diameter, finished stack-exiting workpiece. After each grinding operation, the workpieces and regulating wheel are retracted from the grinding wheel and the workpiece stack is advanced to the next subsequent grinding station. However, one difficulty is inherent in this method of progressively producing the stacked workpieces, in that since the regulating wheel is linearly fed towards the grinding wheel, the same amount of grinding stock is removed from each workpiece in the same time interval.

When grinding, it is generally preferably to rough grind a relatively large amount of stock from a workpiece per unit time, shaping to a predetermined diameter, then later finish grinding the workpiece by removing a relatively small amount of stock per unit time from the predetermined intermediate diameter to the finished size, since wheel pressures and resulting deflections of the workpiece will be lessened during the finish grinding operation and the workpiece will tend to have a truer size and shape and better surface finish.

Applicant has obviated the difficulties inherent in the prior art design by employing a profiled regulating wheel which conforms generally to a stack of progressively reduced work sizes ranging from a largest size at an inlet end between the wheels to a smallest size at an outlet end between the wheels, wherein grinding feed is accomplished by pivoting the regulating wheelhead about a pivot point near the outlet end of the wheel. In this pivoting manner, the feed movement, or feed arc, is proportional to the distance from the pivot point to the successive pieces. Thus, a coarse-feed movement at the inlet end and fine-feed movement at the outlet end is achieved, with respective proportions therebetween along the wheel face. The pivot point, work support and regulating wheel are compensatingly movable in a linear direction towards the grinding wheel to adjust the work stack to the grinding wheel face after the grinding wheel has been conditioned by a suitable dressing means. The work engaging surfaces of the regulating and grinding wheels are angled to generate a conical workpiece at each station, so that all workpieces will remain coaxial and thereby be driven together with parallelism of the faces in contact maintained. "Oversquare" parts (i.e. diameter-greater-than-length), would be likely candidates for this application because they are much narrower than the wheel—thus inefficient to grind one at a time, and large in diameter—meaning long infeed times that can better be broken up into progressive plunges. The finished included cone angle of a given work station is equivalent to the beginning cone angle of the next successive work station; that is, the beginning cone angle is the included angle formed by the grinding wheel face and the retracted regulating wheel face. By this method of progressive angle development of the successive workpiece stations, it is insured that as the regulating wheel is pivoted relative to the grinding wheel, the grind will start along the entire length of the workpiece, tending to cause a more efficient grind operation and a lessening of wheel wear.

If the wheel surfaces are parallel to the part axis (no progressive angle development) the parts will start grinding at one extreme end (toward the pivot) in a most unstable condition. Any roundness error introduced in this portion of the cycle must be generated out only after the stable support stage is reached.

It is therefore an object of the present invention to provide a relatively simple feed mechanism for a stack of workpieces, which accomplishes varying feed and rate increments at the respective workpieces from an inlet end to an outlet end between the wheels.

Another object of the present invention is to provide progressive angle development for a stack of workpieces to be infeed ground on a centerless grinding machine.

Still another object of the invention is to insure that, from the first contact of the wheel with the part until the end of the grind cycle, the port is completely supported along its entire length in the Vee formed by the work support blade and the regulating wheel.

A further object of the invention is to provide an efficient grind operation and a lessening of wheel wear when "station grinding" parts on a centerless grinder.

SUMMARY OF THE INVENTION

The invention is shown embodied in a centerless grinding machine having a base which carries a rotatable grinding wheel and a regulating wheel is rotatable carried in a regulating wheelhead on the base so as to form an inlet end and an outlet end between the wheels. A work support is located between the wheels and carries a plurality of workpieces, defining a plurality of work stations for a plurality of "infeed" grind operations. The regulating wheel and grinding wheel have angled faces at the work stations conforming to the progessively reduced workpiece diameters, and the regulating wheel is relatively pivoted with respect to the grinding wheel about a point proximate to the outlet end, so that as the wheels are relatively pivoted, varying feed movements occur along the face of the wheels which are proportional to the distance from the pivot point to the respective workstations. The wheel faces are angled at the respective work stations so as to generate progressively varied conical workpieces, maintained coaxial with one another during the grind process, and wherein the finished cone generated at a given work station is equivalent to the beginning cone of the next successive station. The included cone angle becomes progressively reduced, from the sharply convergent "rough" stations, to the substantially straightsided exiting workpiece.

DESCRIPTION OF THE PREFERRED EMBODIMENT

Figure 1:
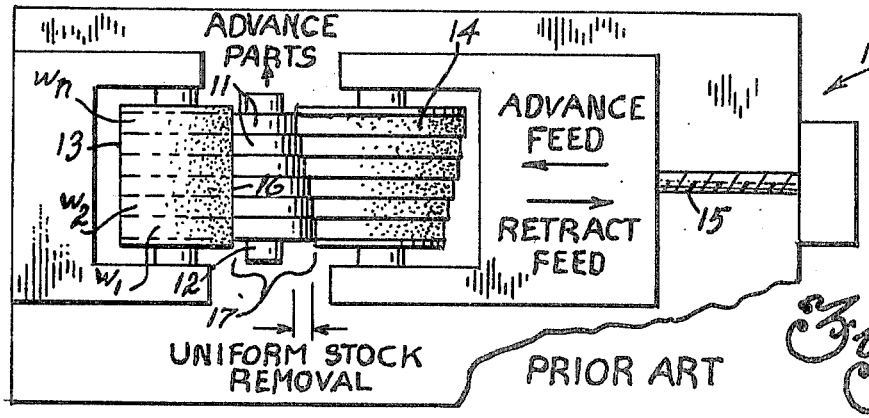
FIG. 1 is a plan view of a prior art centerless grinder performing a constant stock removal rate infeed grind operation on a plurality of workpieces.

FIG. 1 depicts one prior art grinding machine 10 capable of grinding a plurality of workpieces 11 which are carried on a work support 12 between a grinding wheel 13 and a regulating wheel 14. The surfaces to be ground on the workpieces 11 depicted are cylindrical, and it is desired to grind them in an "infeed" grinding mode, i.e. the workpieces 11 remain axially stationary while being ground. The workpieces 11 are sucessively reduced in diameter from an entering, "rough", workpiece size to an exiting, "finish" workpiece size, and the regulating wheel 14 is therefore generally stepped along its length to maintain contact with the range of workpieces 11. Feed movement is accomplished by linearly moving the regulating wheel 14 radially with respect to the grinding wheel 13 along a feed screw 15, and, therefore consequently removing stock at a constant rate from each workpiece 11, simultaneously. After a grind operation, the regulating wheel 14 is retracted and the workpiece stack is axially advanced by a feeding mechanism (not shown) to index the workpieces 11 to their next successive work stations "$W_1$", "$W_2$", . . . "$W_n$" defined in phantom along the face 16 of the grinding wheel 13, and a new rough workpiece 11 enters at the inlet end 17 between the wheels 13,14.

Figure 2:
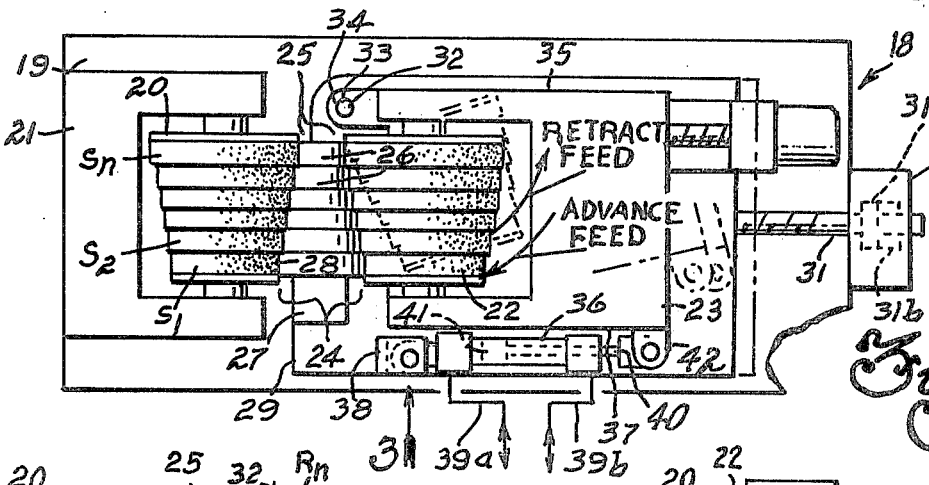
FIG. 2 is a plan view of a centerless grinder performing variable stock removal rate infeed grind operations on a plurality of workpieces.

The plan view depicted in FIG. 2 illustrates a centerless grinding machine 18 of the general design illustrated in my copending application, Ser. No. 803,569, having a base 19, and grinding wheel 20 is rotatably carried in a grinding wheelhead 21 which in turn is affixed to the base 19. A regulating wheel 22 is rotatably journaled in a regulating wheelhead 23 and is movable relative to the grinding wheel 20, defining an inlet end 24 and an outlet end 25 between the wheels 20,22. A plurality of workpieces 26 are carried on a work support 27 between the wheels 20,22 in conventional manner, and the exemplary workpieces 26 depicted are cylindrical rods stacked for infeed grinding. The plurality of workpieces 26 define a plurality of work stations "$S_1$", "$S_2$", . . . "$S_n$" along the face 28 of the grinding wheel 20 and the grinding wheel 20 is shaped to conform to the desired workpiece profile at the work stations "$S_1$", "$S_2$" . . . "$S_n$". The work support 27 is carried on a slide 29 which is radially movable in a linear fashion with respect to the grinding wheel 20 by means of an infeed unit 30 affixed to the base 19. A feed screw 31 is threadably engaged in the slide 29 to provide adjustment, and a piston **31*a* is operable in a cylinder 31*b* to retract the screw 31 and slide 29 to provide clearance between the workpieces 26 and the grinding wheel 20 when advancing the workpieces 26 to their subsequent work stations "$S_1$", "$S_2$" . . . $S_n$. The regulating wheel 22 is step-profiled along its length to conform to successively reduced workpiece sizes from the inlet end 24 to the outlet end 25 of the wheels 20,22. In the preferred embodiment, the grinding wheel 20 is shaped such that the workpieces 26 will be concentric, thus tending to minimize relative slip between the workpieces 26. It may be appreciated that the wheel 20 may be shaped in similar fashion as the prior art wheel 13**.

The regulating wheelhead 23 is pivotable on the slide 29 about a pivot point 32 established by a pivot pin 33 relatively fixed in the slide 29 and having a slip fit in a cooperating bore 34 in the regulating wheelhead 23. The pivot point 32 is located proximate to the outlet end 25 of the wheels 20,22 i.e. at the rear 35 of the regulating wheelhead 23, while a fluid-operated cylinder 36 is clevis-mounted to the slide 29 proximate to the front 37 of the regulating wheelhead 23 by a bracket 38 and connected by fluid lines **39*a,b*, to a suitable fluid power source (not shown), and the external rod end 40 of the relatively movable piston 41 is clevis-mounted to the regulating wheelhead 23 by a bracket 42 affixed to the front 37. Thus, as the piston 41 is powered in the cylinder 36, the regulating wheelhead 23 will pivot from the solid position shown to the phantom position, and the reverse. Feed movement, therefore, is arcuate about the pivot point 32. Total movement is compounded of straight movement for clearance and arcuate movement for grinding. When the grind operation has been completed, the regulating wheel 22 is retracted and the workpieces 26 are advanced to their next subsequent stations, while a rough workpiece 26** enters the system by means of a workpiece axial indexing mechanism (not shown) and the next grind operation is ready to commence.

To compensate for grinding wheel wear, the slide 29 and regulating wheel 23 are compensatingly advanced by the feed screw 31. The regulating wheelhead upper portion **23*a* moved relative to the lower portion 23*b*** to compensate for regulating wheel wear.

Figure 3:
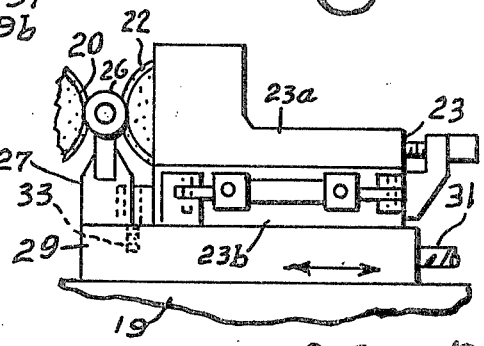
FIG. 3 is an elevational view of the centerless grinder taken in the direction of arrow 3 of FIG. 2.

FIG. 3 depicts the slide 29 on the base 19 where it may be linearly fed by the feed screw 31 or piston **31*a*, and the slide 29 carries the pivotable wheelhead 23 and the work support 27**.

Figure 4:
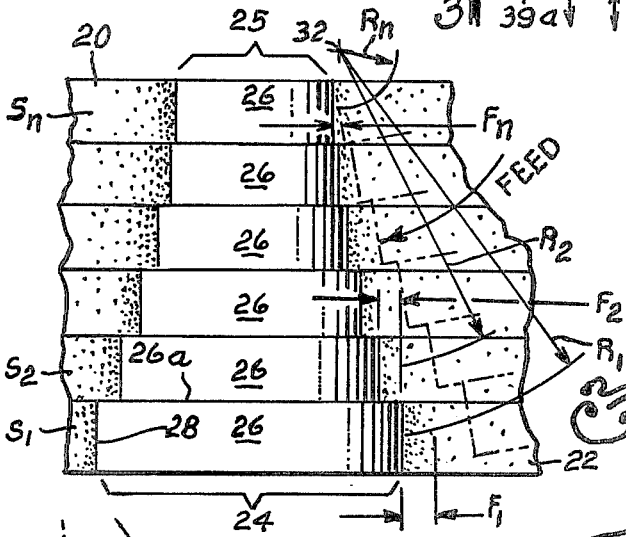
FIG. 4 is an enlarged plan view of the grinding zone of the centerless grinder of FIG. 2.

FIG. 4 is an enlarged view showing the grinding zone of FIG. 2 during a feed operation. Here it may be seen that the workpieces 26 vary in diameter from the inlet end 24 to the outlet end 25 between the wheels 20,22 and the grinding wheel 20 is shaped to conform to the desired workpiece profile at the plurality of work stations "$S_1$", "$S_2$" . . . "$S_n$", defined along its face 28. The regulating wheel 22 is step-profiled to maintain contact with the progressive work sizes, and, as the regulating wheel 22 is fed arcuately in the direction of the arrow, it will be seen that the amount of stock removal "$F_1$", "$F_2$", . . . "$F_n$" will be directly proportional to the radial distances from the pivot point 32 to the workpieces 26, "$R_1$", "$R_2$", . . . "$R_n$". All stock removal takes place during the same time interval, and in this fashion, therefore, a coarse-grind rate is achieved at the inlet end 24 and a fine-feed grind rate is obtained at the outlet end of the wheels 20,22 and proportional feed rates on all the workpieces 26 therebetween.

It can be seen, however, that such a pivotable feed arrangement may cause grinding action to initiate at the leading edge **26*a* of the station-advanced workpiece 26**, which may operate to the detriment of the operation by increasing wheel breakdown and contributing to any workpiece instabilities.

Figure 5:
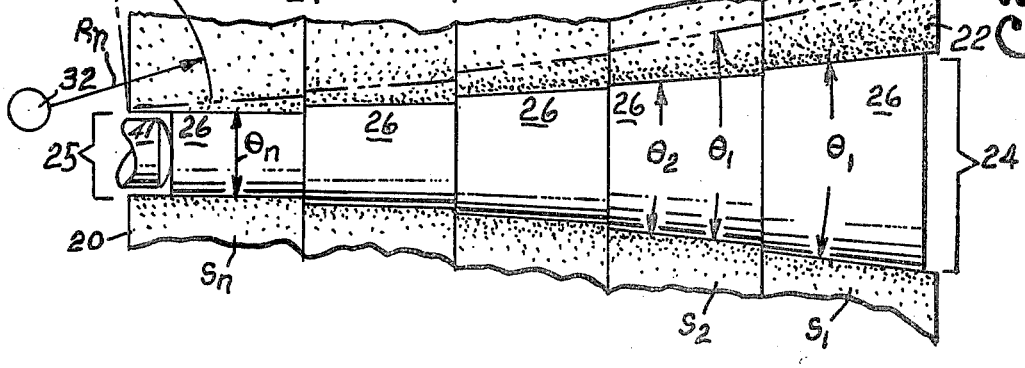
FIG. 5 is a plan view of the grinding zone of the centerless grinder of FIG. 2, illustrating the progressive angle development of the work stations.

FIG. 5 illustrates an alternate embodiment for producing a cylindrical workpiece with the pivotable regulating wheelhead arrangement of FIGS. 2, 3, and 4.

Using the terminology associated with FIG. 4, the respective wheel faces at each work station, "$S_1$", "$S_2$", . . . "$S_n$" are angled to produce a finished workpiece 26 having the shape of a truncated right cone of included cone angle $\theta_{1, 2, \ldots n}$, wherein the finished cone angle of a given work station is the beginning, or "rough", cone angle of the next successive work station; that is, the beginning cone angle is the angle formed by the grinding wheel face and the retracted regulating wheel face.

An endstop 41 is depicted as a way to maintain axial positioning of the workpieces 26; and may be movable by a suitable mechanism (not shown) to reposition the workpieces 26.

The work support blade (not shown) is likewise configured to keep the workpieces coaxial.

The progressive angle development of the respective work stations thereby causes the grind to start substantially along the entire length of the workpiece 26, thereby tending to increase grind efficiency and equalize wheel wear. The included angle $\theta_n$ of the last workpiece 26 is, of course, by design, 0° to produce the desired cylinder at the outlet end 25 of the wheels 20,22. It can be readily appreciated, however, that workpieces having angled surfaces, or combinations of angled, flat, and varied profiles may be produced utilizing the teachings of this invention.

It is preferable to provide identical angles on the wheel faces, to maintain the parts in a coaxial manner, and to facilitate common wheel dressing elements. Although there may be slip between the parts due to their different diameters, in a maintained coaxial condition, the slip is symmetrical around the axis, and the effect is purely angular. There are no radial influences introduced to effect roundness.

It is not intended that the invention be limited to the embodiments shown in the drawings, but rather that the invention also comprises all such designs and modifications as may come within the scope of the appended claims.

What is claimed is:

1. An improved centerless grinder having a base, a grinding wheel and regulating wheel rotatably journalled in respective grinding and regulating wheelheads carried by said base, said wheels disposed to one another so as to form an inlet end and outlet end between said wheels, and a work support located between said wheels for supporting a workpiece of revolution, wherein the improvement comprises:

(a) a plurality of work stations defined along the faces of said wheels comprising a like plurality of frustoconical wheel segments on each wheel with bases disposed toward said outlet end and the included angle of the wheel segments progressively decreases from the segment proximal the inlet end to the segment proximal the outlet end on each of said wheels, respectively; and (b) means for effectuating relative movement between said regulating wheel and said grinding wheel about said outlet end during the grinding process between a first beginning position and a second, finished position thereby establishing a work cone profile at each of said beginning and finished positions wherein the finished work cone profile of a given work station is equal to the beginning work cone profile of the next successive work station.

2. The grinder of claim 1, wherein said wheels are conditioned to simultaneously contact a serially-related plurality of workpieces while grinding.

3. The grinder of claim 1 or 2 wherein said grinding wheelhead is affixed to said base and said regulating wheelhead is moveable about a pivot point proximal said outlet end.

* * * * *